US008240731B2

(12) United States Patent
Roszak

(10) Patent No.: US 8,240,731 B2
(45) Date of Patent: Aug. 14, 2012

(54) METHOD USING DEVICE FOR EASY PICK UP OF SMALL OBJECTS

(76) Inventor: Amy Claire Roszak, Poulsbo, WA (US)

( * ) Notice: Subject to any disclaimer, the term of this patent is extended or adjusted under 35 U.S.C. 154(b) by 134 days.

(21) Appl. No.: 12/584,035

(22) Filed: Aug. 31, 2009

(65) Prior Publication Data

US 2010/0065208 A1 Mar. 18, 2010

Related U.S. Application Data

(60) Provisional application No. 61/191,992, filed on Sep. 15, 2008.

(51) Int. Cl.
*B66F 19/00* (2006.01)
*B25J 15/00* (2006.01)

(52) U.S. Cl. ..... 294/212; 294/25

(58) Field of Classification Search ..... 294/1.1, 294/26, 25, 209, 212, 219; 43/136; 132/73, 132/73.5, 75, 75.3; 15/104.002, 209.1
See application file for complete search history.

(56) References Cited

U.S. PATENT DOCUMENTS

| | | | | | |
|---|---|---|---|---|---|
| 3,985,383 | A | * | 10/1976 | Yonkers | 294/25 |
| 4,174,620 | A | | 11/1979 | Russell | |
| 4,285,114 | A | * | 8/1981 | Underdahl | 29/451 |
| 4,993,949 | A | | 2/1991 | Hill | |
| 5,251,943 | A | * | 10/1993 | Dalbo et al. | 294/212 |
| 5,256,064 | A | | 10/1993 | Riihimaki et al. | |
| 5,609,375 | A | * | 3/1997 | Cohen | 294/25 |
| 5,952,422 | A | * | 9/1999 | Chang et al. | 524/590 |
| 6,175,984 | B1 | * | 1/2001 | Prime et al. | 15/104.002 |
| 6,220,250 | B1 | * | 4/2001 | Park | 132/73 |
| 6,877,273 | B2 | * | 4/2005 | Anderson et al. | 43/136 |

FOREIGN PATENT DOCUMENTS

GB 2198949 * 6/1988

* cited by examiner

*Primary Examiner* — Paul T Chin
(74) *Attorney, Agent, or Firm* — Patent Ingenius, LLC; Scott E. Gilbert

(57) ABSTRACT

A method for picking up small objects using a pliable, tacky composition whereby after the composition is touched to a small object so that the object temporarily adheres to it, the object can be manually removed or transferred from the composition. The tacky composition may be used with an apparatus.

1 Claim, 3 Drawing Sheets

METHOD USING DEVICE FOR EASY PICK UP OF SMALL OBJECTS

This application claims the benefit of provisional patent application Ser. No. 61/191,992 filed on Sep. 15, 2008.

FIELD OF THE INVENTION

The present invention relates to hand tools, and more specifically, it is directed towards a hand tool with a tacky composition to make it easy to pick up and place small objects.

BACKGROUND OF THE INVENTION

This invention relates to several different fields of application, including, but not limited to, crafts, fingernail art, pharmaceutical, and industrial-home workshops. In each situation, an object needs to be picked up, which is difficult both because the object is small and challenging to grasp or place, or because of user limitations, for example, those caused by arthritis or limited vision.

In crafts such as scrap booking, card making, sewing, bead works, clay working, apparel or shoe adornment and egg decoration, tiny embellishments, including but not limited to gems, sequins, punched shapes and buttons, are placed onto an adhesive, then strung, pressed into clay, or objects such as sewing pins that have scattered need to be picked up. Tweezers or fingers are the most common implements used to pick up and place these tiny objects, however, serious limitations are encountered in the form of imprecise placement using fingers and objects getting bent, crumpled or shooting out of the grips of tweezers.

Nail artists place ultra small jewels and decorations onto wet nail polish. Tweezers, or a brush dipped in wet polish, are the most common implements used to pick up and place these small jewels. Difficulty with current methods includes the jewels shooting out from the grip of the tweezers and transferring from the equally tacky polish on the brush to the fingernail polish.

In the pharmaceutical/dental/medical arena, small pills or appliances can be challenging to pick up due to the object's size or because of user limitations such as dexterity or eyesight.

In workshop applications, washers, screws and the like can be difficult to grasp and place into a proper location. Those skilled in the field know that while many tools are available with magnetic tips, non-steel items will not stick to a magnet, and many tools do not have a magnetic tip.

One embodiment of the prior art device taught in Dalbo U.S. Pat. No. 5,251,943 calls for a kit that would include a bottle of "pressure-sensitive adhesive", which would be applied to an elongated member. This invention is directed only towards the picking up of tiny craft beads. In beading, release is irrelevant as a needle completes the transfer. Disadvantages of this invention to other uses include an 1) inherent delay time required for drying the liquid adhesive, 2) limitations of size, weight and shape of objects as pressure sensitive adhesive can not hold chunky, irregular objects, 3) unattractive and contaminated layers of adhesive on the elongated member from repeated applications, and 4) difficult transfer of an embellishment onto another adhesive or onto wet nail polish from the high-tack pressure sensitive adhesive on the elongated member.

There is clearly a need which would allow the nail artist to seamlessly pick up and precisely place embellishments onto a project, arthritic fingers to easily pick up pills and small items, screws to be held fast to a screw driver, and other uses involving picking up and placing small objects. This need is met by the present invention, which is summarized and described below.

BRIEF SUMMARY OF THE INVENTION

Relating to the difficulties and frustrations incurred by using the prior art methods and tools for picking up and placing small items, the inventor has found a solution to this long-standing problem. The inventor has shown that the necessary product to replace the existing prior art solutions will pick up and hold fast small dimensional objects in a variety of sizes, shapes and compositions, yet release them easily and instantly such as when setting the objects onto an adhesive or sticky surface. A strong hold with instant release or transfer is essential for proper function.

Thus, according to the principle aspect of the present invention, there is provided a pliable, tacky adhering agent disposed on an applicator, the combination of which is used for manual pick and place operations involving small items in crafting, hobby or industrial settings. The heart of the invention is a the adhering agent, which temporarily adheres to small items, forming a weak adhesive bond with the item and allowing transfer and precise placement of the small item by manipulation of the applicator.

In a second aspect of the present invention, there is provided a method for using the tacky composition in combination with an applicator for performing pick and placement operations involving small items efficiently without the use of expensive specialized tools.

DETAILED DESCRIPTION OF THE INVENTION

In the broadest aspect of the present invention, there is provided a small quantity of pliable, tacky composition comprising silicone or wax similar to the silicones and waxes used for orthodontic irritation relief, or a non-drying polymer clay-like product, disposed on an applicator. The invention allows for multiple degrees of tackiness from "craft strength" to "industrial strength". Craft strength requires the delicate balance of pickup and hold yet instant release or transfer. For applications requiring a stronger hold and where transfer release is not a requirement, a pliable wax similar to orthodontic relief wax is the preferred material. FDA-approved orthodontic silicone and relief waxes are also ideal in situations where toxicity is a concern.

Figure 1:
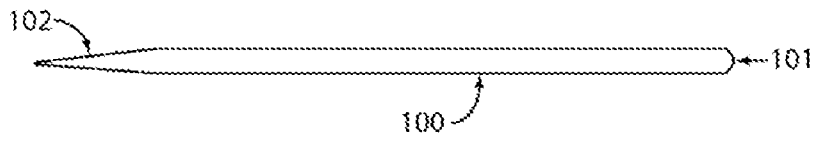
FIG. 1. Illustration of the preferred embodiment of the applicator.

Referring to FIG. 1, the preferred embodiment of the applicator is a thin wand 100 with a blunt end 101 and a pointed end 102. The wand's diameter is quite thin to minimize interference, obstruction or impressions, for example when pressing a gem into clay, and the length is appropriate to be easily held in the hand. This particular embodiment is an example purely for illustrative purposes, and not meant to be construed as a limitation of the invention. Alternative embodiments of the apparatus are feasible.

Figure 2:
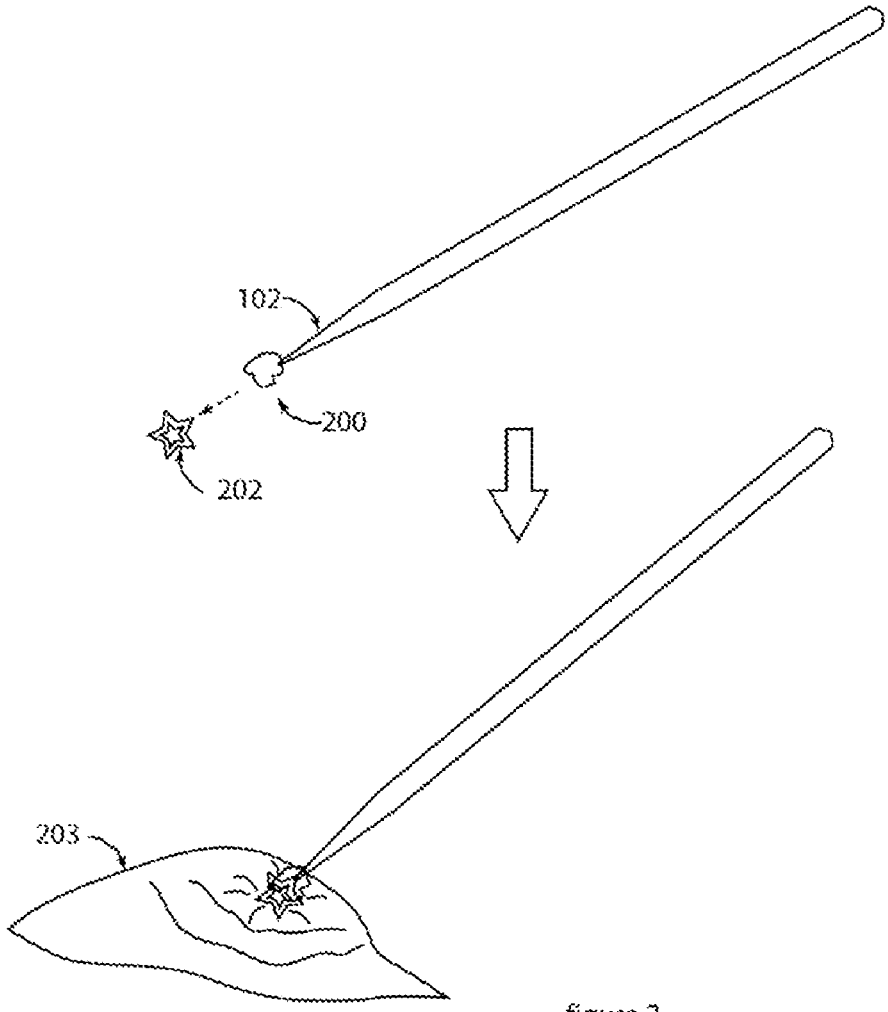
FIG. 2. Illustration of the preferred embodiment of the method of use of the invention.

Use of the present invention is straightforward. Referring to FIG. 2 for the preferred use of the invention, a small piece of the tacky transfer composition, or adhering agent 200 is disposed at one end of the wand 102. The small piece of adhering agent 200 is touched, either by manual manipulation of the wand, or by an automated apparatus controlling the wand's position and orientation, to a small embellishment object 202, forming a weak adhesive bond between the object and the transfer composition, so that the object temporarily adheres to it, allowing the wand to transfer and place the object at a particular desired location or placement on a receiving surface without falling off the wand. The small object can take the form of, but is by no means limited to, a miniature crafting embellishment, a small jewel, a small bead, a mechanical part such as a small screw or nut, or a small electronic component. The object is then transferred by the wand and positioned over a desired location on receiving surface 203 that either is inherently tacky, such as but not limited to, clay, double sided tape or tack paper, where an uncured but tacky adhesive has been applied on an inherently non-tacky surface such as paper, glass, metal or plastic, or in other embodiments, to a mechanical grasping means, embedded in or attached to the receiving surface, such as a bezel for a jewel setting or a threaded hole for receiving a small screw, all of which are defined as adhering elements for the purposes of this specification. In all cases, the receiving surface, by means of adhering elements, provides a greater tack value or holding force relative to that of the tacky transfer agent disposed on the end of the wand, allowing the object to form an instant bond or mechanical attachment with the receiving surface when touched to it, wherein the bond between the object and the receiving surface is stronger than the first bond between the object and the transfer agent. This allows the object remain attached to the receiving surface at the desired location when the wand is withdrawn from the surface. The transfer agent remains on the wand, and can be reused as long as it is effective. It can be replaced with a small quantity of fresh composition when necessary.

EXAMPLES

Figure 3A:
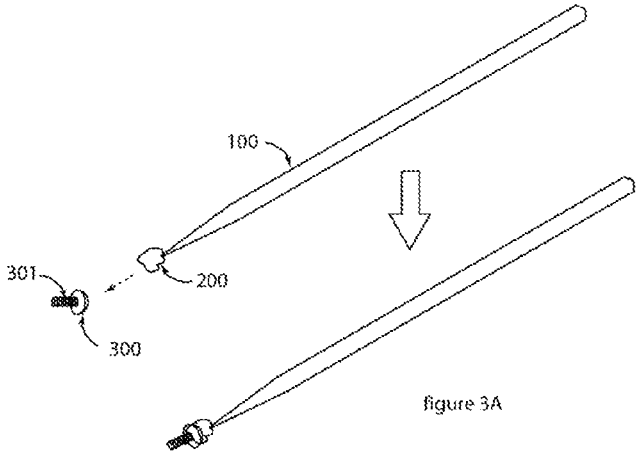
FIG. 3A. Illustration of an example of use of the invention to pick up a small mechanical part, in this case a small screw.
Figure 3B:
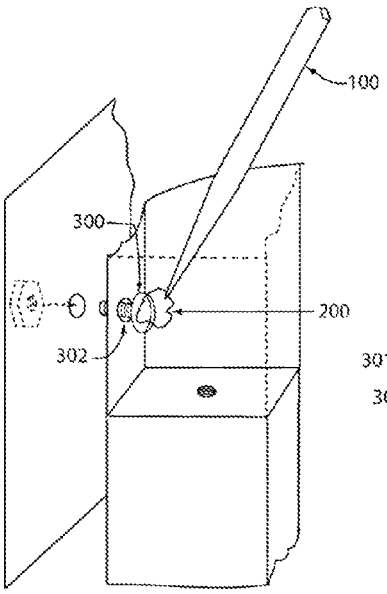
FIG. 3B. Illustration of the use of the invention to precisely place a screw through a hole in a confined space.
Figure 3C:
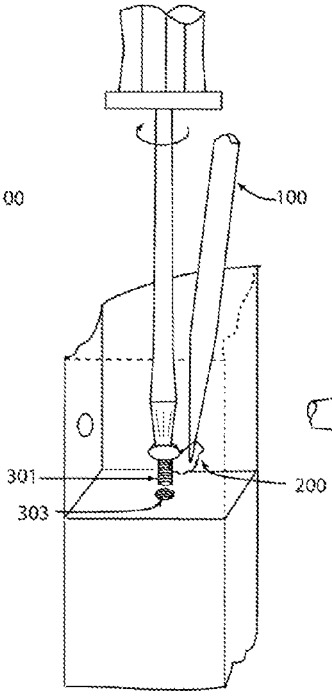
FIG. 3C. Illustration of the use of the invention to precisely place a small screw at the top of a threaded hole in a confined space, holding the small screw by its shaft.
Figure 3D:
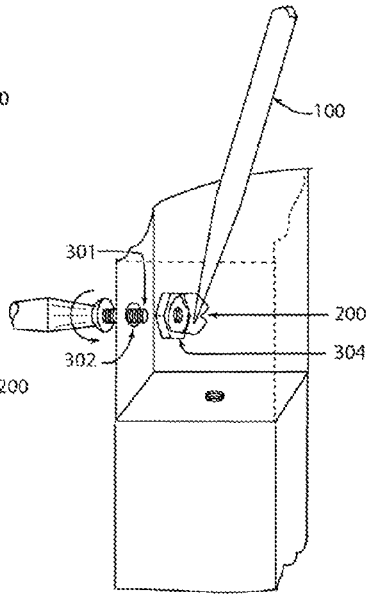
FIG. 3D. Illustration of the use of the invention for positioning a small nut in a confined space to engage the shaft of a small screw inserted through a hole.

Picking up and placing small mechanical parts, such as 0-80 size machine screws or nuts, can be challenging tasks, especially in confined and difficult to reach areas where parts must be fastened using small, or even large, fasteners. Special tools are generally required to perform repeated fastening tasks efficiently with such small parts, such as magnetized socket wrenches to pick up a small steel nut, precisely place it on the end of a steel screw shaft and engage the threads while the head of the screw is held from turning with a magnetized screw driver. Placing a small screw through a hole in a difficult location may require the use of a magnetic screwdriver, but the screw can be difficult to align to enter the hole because the screwdriver can only hold the screw at one point. The present invention can be used as an inexpensive alternative to magnetized screwdrivers or socket wrenches, particularly when the small parts are made from non-ferrous materials. In this example, and as depicted in FIG. 3A, a small amount of tacky transfer agent, such as medical grade silicone, is disposed on the end of an applicator wand 100 so as to form a lump of transfer agent 200, and the head 300 of a small screw is pressed into the lump to align shaft 301 of the same screw coaxially with wand 100, or in any desired orientation. As shown in FIG. 3B, with the use of wand 100, the screw is transferred and placed into through hole 302. Alternatively, as shown in FIG. 3C, shaft 301 of the screw can be in contact with composition 200, whereby the screw can be transferred to threaded hole 303 and held in place by the wand while the screw is turned with an ordinary screwdriver to engage the threads. Finally, placement of small nut 304 onto the end of screw shaft 301 can be accomplished by pressing the composition disposed 200 on the wand 100 against one of the faces of the nut 305, transferred and precisely placed on the end of the screw shaft (FIG. 3D). While held in place by the wand, the screw is turned with a screwdriver to engage the threads. While a stylus is used in this example of an applicator, a screwdriver can also be used directly as a means to attach the tacky composition.

The present invention is particularly useful for placing small electronic components on printed circuit boards. This is particularly important for surface mount technology (SMT) components, which are very popular with hobbyists. SMT components such as capacitors, inductors, resistors, diodes and integrated circuits are typically one or two millimeters in size, non-magnetizable and difficult to grasp with tweezers or pliers because of their shapes and smooth surfaces. In this example, the same methods described above for the example demonstrating use with small mechanical parts can be applied for the present example.

Figure 4:
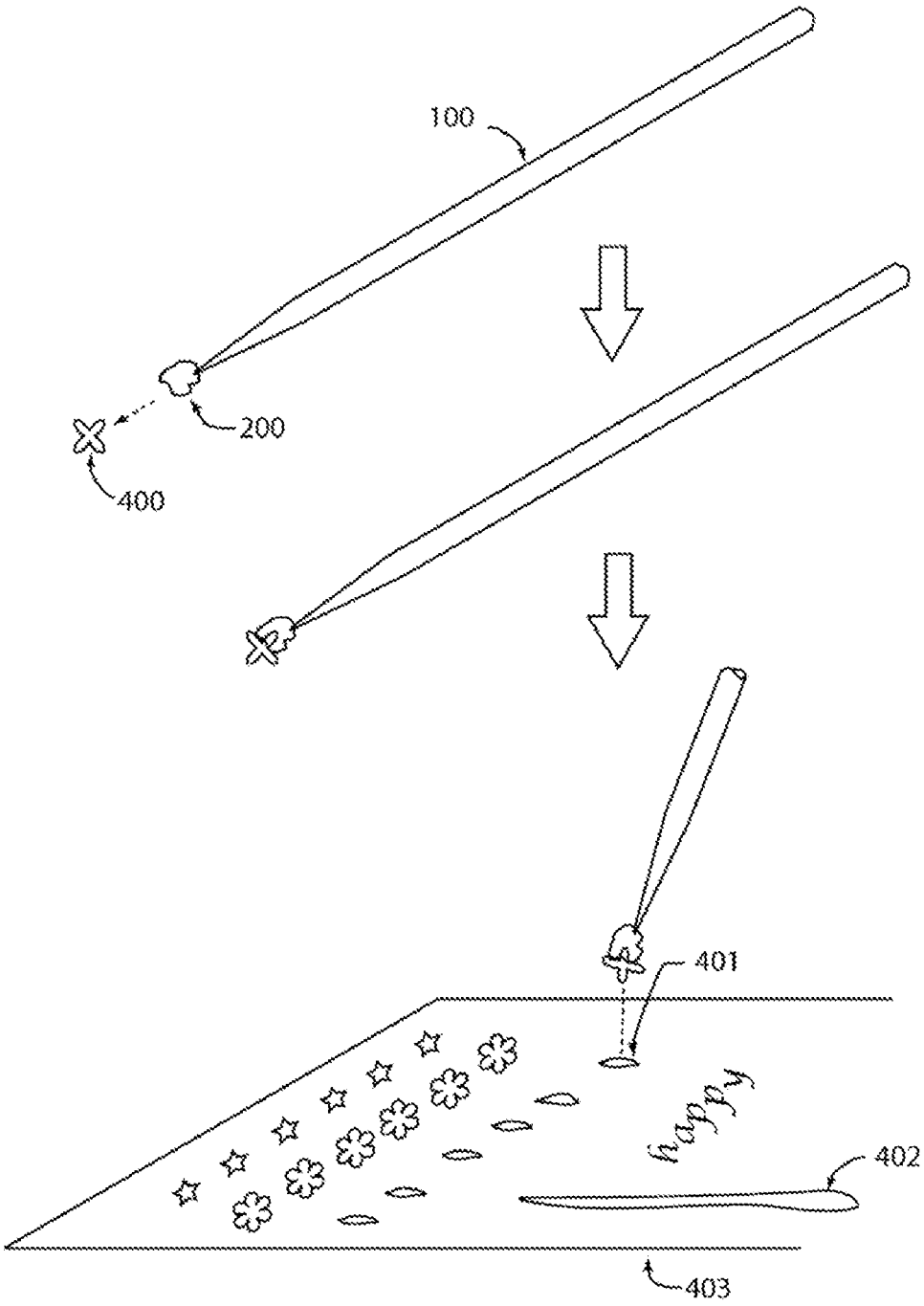
FIG. 4. Illustration of an example of the use of the invention for craft or art projects to pick up and place small embellishments on adhesive patches applied to a greeting card.

Crafting embellishments, consisting of wool fibers, metal eyelets, and plastic confetti are to be adhered to adhesive on a greeting card. Difficult to pick and even more challenging to set in the precise location the adhesive, the task is frustrating. With tweezers, the eyelets pop out of the grips, and the confetti is difficult to grasp. In FIG. 4, the tacky transfer composition 200 disposed on the end of the wand 100 easily picks up the embellishments 400 and instantly transfers the items to the tackier drops 401 and lines 402 of adhesive on the card 403.

As a final example, the present invention can be used to aid in cake and confectionary decoration. Edible sugar decorations can be small and irregularly shaped, and in addition are fragile. The present invention is especially well suited to pick up and placement of these delicate objects, such as placement on gum paste used to adhere the decoration to the confectionary item.

The terms and expressions that have been employed in the foregoing specification are used therein as terms of description and not of limitation, and there is no intention in the use of such terms and expressions of excluding equivalents of the features shown or portions thereof, it being recognized that the scope of the invention is defined and limited by the claims which follow.

The invention claimed is:

1. A method of picking and placing decorative embellishments at a predetermined location on a crafting surface, comprising:

i) Providing an elongated applicator tool, wherein said applicator tool comprises a handle portion and two terminal portions;

ii) Disposing a quantity of a deformable semi-solid non-hardening adhering agent on one of said terminal portions of said applicator tool in such a way that said adhering agent substantially adheres to and encapsulates said terminal portion of said applicator tool, protruding therefrom, forming an adhering tip comprising a tacky surface;

iii) Pressing said tacky surface of said adhering tip against a decorative embellishment by manipulation of said applicator tool in such a way that the embellishment becomes temporarily affixed to the applicator tool;

iv) Moving and orienting the applicator in such a way that the embellishment is positioned substantially close to the desired placement location on a crafting surface, wherein said desired placement location comprises a plurality of adhering elements; and v) Touching said embellishment to, an adhering element on said crafting surface, wherein said embellishment becomes affixed to said crafting surface and detaches from said applicator tool when said tool is withdrawn from said crafting surface.

* * * * *